US006857158B1

(12) United States Patent
Hunter et al.

(10) Patent No.: US 6,857,158 B1
(45) Date of Patent: Feb. 22, 2005

(54) APPARATUS FOR CLEANING THE INTERIOR OF PIPELINES

(76) Inventors: Junius Hunter, 863 Colt Dr., Wake Forest, NC (US) 27587; Mark R. Stephenson, 3809 Frazier Dr., Apt. 103, Raleigh, NC (US) 27610

( * ) Notice: Subject to any disclaimer, the term of this patent is extended or adjusted under 35 U.S.C. 154(b) by 0 days.

(21) Appl. No.: 10/625,168

(22) Filed: Jul. 24, 2003

(51) Int. Cl.[7] ..... B08B 9/32
(52) U.S. Cl. ..... 15/104.061; 138/93; 134/167 C
(58) Field of Search ..... 15/104.061, 104.062, 15/104.068, 104.05; 134/166 C, 167 C, 168 C, 169 C; 138/93

(56) References Cited

U.S. PATENT DOCUMENTS 3,600,736 A * 8/1971 Smith et al. ..... 15/104.061
3,902,528 A * 9/1975 Tartabini et al. ..... 138/90
4,077,080 A * 3/1978 Ross ..... 15/104.061
5,875,803 A 3/1999 Leitko et al.
6,070,285 A 6/2000 Geppert

* cited by examiner

*Primary Examiner*—Robert J. Warden, Sr.
*Assistant Examiner*—Laura C Cole
(74) *Attorney, Agent, or Firm*—Norman Rainer

(57) ABSTRACT

An apparatus for removing deposits from the interior surface of a conduit while being advanced through the conduit by virtue of pressurized upstream liquid includes front and rear assemblies interconnected in a manner to permit limited movement there between. The rear assembly contains a mechanism for receiving the upstream liquid and increasing its pressure. The liquid of increased pressure is fed to a rotating nozzle in the front assembly. High velocity water jets emergent from the nozzle strike the interior surface of the conduit to dislodge deposits. A resilient sidewall in one or both assemblies expands by virtue of the liquid of increased pressure to apply a controlled braking force against the interior surface of the conduit.

14 Claims, 5 Drawing Sheets

APPARATUS FOR CLEANING THE INTERIOR OF PIPELINES

BACKGROUND OF THE INVENTION

1. Field of the Invention

This invention relates to an apparatus for cleaning the interior wall of a pipeline carrying a petroleum oil or hydrocarbon gas that tends to deposit a wax-like layer on said interior wall, and more particularly concerns a pipeline cleaning apparatus that can be controllably advanced by fluid pressure applied through said pipeline upon said apparatus.

2. Description of the Prior Art

Solids such as paraffin wax and related viscous products tend to deposit on the interior wall of oil and gas pipelines, and the accumulation of such deposits is accelerated by cold temperatures. Mechanical cleaning devices, commonly called pigs, are often used to clean such pipelines. Pigs are generally plugs that can slide through the pipeline by the force of fluids behind the pig, removing undesirable materials by pushing these materials in front of the pig. In long pipelines, stations to launch and catch these pigs are typically provided in the pipeline.

A problem when using a pig is that the debris dislodged from the interior wall as the pig progresses through the pipeline can accumulate and block further motion of the pig. This phenomenon is aggravated with increased speed of the pig. Such blockage requires expensive remediation in terms of locating and accessing the site of blockage, cutting the pipeline, removing the pig and the blocking accumulation, and re-welding the pipeline. Such remediation is particularly costly with undersea pipelines.

In order to minimize the accumulation of debris in front of the advancing pig, rotating nozzles have been mounted on the forward extremity of the pig for directing high velocity fluid jets toward the interior pipe wall. The jets dislodge the debris and break it into relatively small pieces which are flushed forwardly away from the pig. The energy required to rotate the nozzles is provided by a pressurized upstream activating liquid, which may be water. Activating liquid pressures in the range of 400–500 psi may be employed, and are suitable for rotating the nozzle and advancing the pig. The high velocity jets are produced by hydraulic pressure intensifiers within the pig that generate pressures at the nozzle which are considerably greater than the pressure of the activating liquid.

It is necessary to control the rate of forward movement of the pig. One earlier disclosed technique for controlling the movement of the pig, and facilitating its retrieval in the event of a blockage, has involved the use of a tether cable. However, use of a cable restricts the length of pipeline that can be cleaned because of the weight of an extended length of cable. For example, a pipeline having a length of greater than about a mile would be very difficult to clean with a tether cable. Further, a tensioner and a seal must be provided around the cable where the cable enters the pipeline. This seal provides an opportunity for pipeline contents to escape, resulting in unwanted emissions.

In pig systems utilizing a pressurized upstream activating fluid, various techniques have been described for enabling the pressure of the activating liquid to operate a braking mechanism on the pig so as to control forward movement. For example, U.S. Pat. No. 5,875,803 to Leitko, et. al. discloses the use of a coil spring that fits closely within the pipeline and which elongates in response to pressure, thereby causing a narrowing of the diameter of the spring with attendant release from gripping engagement of the interior surface of the pipeline. Leitko, et. al. also discloses a braking mechanism in the form of brake pads urged against said inside surface by suitable pressure differential.

U.S. Patent to Geppert discloses a pig having a brake mechanism energized by a pressurized activating fluid in a manner such that force is exerted upon clamping shoes interactive with the pipe wall. The intensity of said braking force increases with increased forward motion of the pig.

The braking systems of Leitko, et. al. and Geppert are based upon rigid mechanical structures that are forced against circumferentially spaced sites on the interior of the pipe. Although functionally reliable on a clean pipe surface, their reliability diminishes on surfaces of varying cleanliness because of the unpredictable interaction of the rigid brake pads with surface irregularities at randomly spaced sites. Such prior pig devices also do not clearly address the need for increasing the pressure of the activating liquid for energizing the braking mechanism, and for producing jets of sufficiently high velocity to remove the deposits.

It is accordingly an object of the present invention to provide apparatus with reliable braking means for use in removing solids from the inside surface of conduits.

It is another object of this invention to provide apparatus as in the foregoing object that employs high velocity liquid jets to remove said solids and flush them downstream through said conduit.

It is a further object of the present invention to provide apparatus of the aforesaid nature for use in conjunction with a pressurized upstream liquid for removing solids from the inside surface of a conduit.

It is yet another object of this invention to provide apparatus of the aforesaid nature having the ability to produce hydraulic pressures greater than the pressure of said upstream liquid for operating said braking means and producing said high velocity jets.

These objects and other objects and advantages of the invention will be apparent from the following description.

SUMMARY OF THE INVENTION

The above and other beneficial objects and advantages are accomplished in accordance with the present invention by a pig apparatus for removing deposits from the interior surface of a conduit while being advanced through said conduit by impetus provided by an upstream activating liquid of adjustable pressure and flow exerting a primary operating pressure upon said apparatus, said apparatus comprising:

1) a rear assembly bounded by upstream and downstream faces and a circular cylindrical sidewall, thereby defining an interior region, and intensifier means located in said interior region for increasing the pressure of said upstream liquid to a second operating pressure,
2) a front assembly bounded by upstream and downstream faces in spaced apart parallel relationship on a centered axis and a pliable circular cylindrical sidewall having an outside diameter that closely matches the diameter of the interior surface of said conduit and is outwardly expandable by pressure applied from within said front assembly, said downstream face having nozzle means adapted to rotate upon said axis under the impetus of said second operating pressure liquid, said nozzle means having a forward extremity equipped with a plurality of orifices which produce high velocity jets of liquid directed toward said interior surface, 3) coupling means interactive between the downstream face of said rear assembly and the upstream face of said front assembly for facilitating transfer of liquid at said second operating pressure and permitting limited movement between said front and rear assemblies, and 4) valved flow control means which divert a portion of the fluid at said second operating pressure, causing said diverted fluid to have a third operating pressure which is less than said second operating pressure but higher than said primary pressure, and causing said third operating pressure fluid to activate said pliable sidewall.

In preferred embodiments, a second pliable expandable sidewall is associated with said rear assembly, and said intensifier means is comprised of at least two reciprocating pistons.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
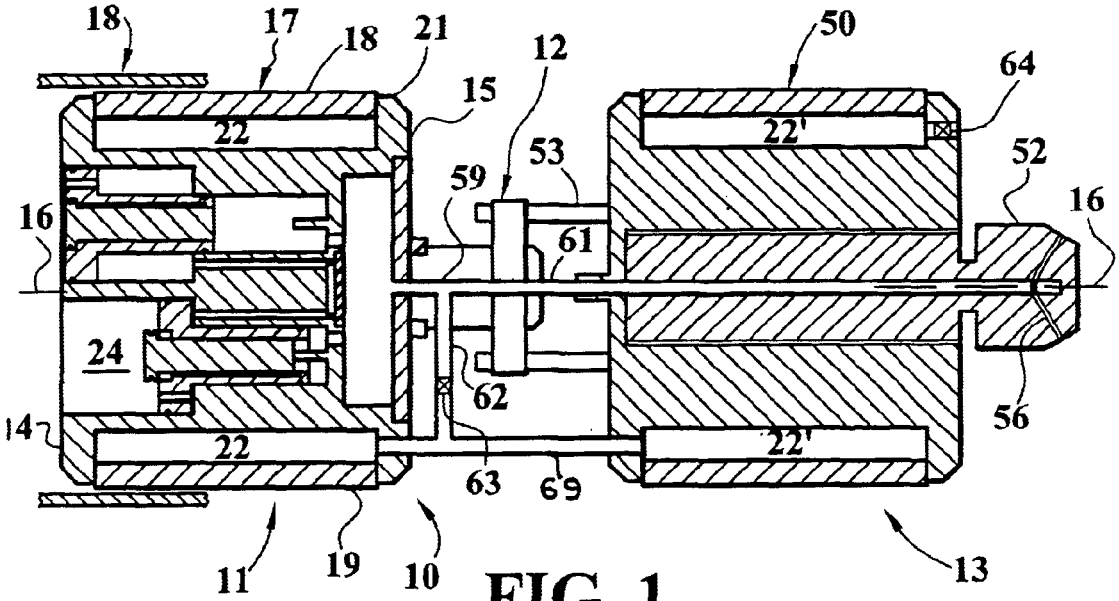
FIG. 1 is a vertical sectional view of an embodiment of the apparatus of the present invention.
Figure 2:
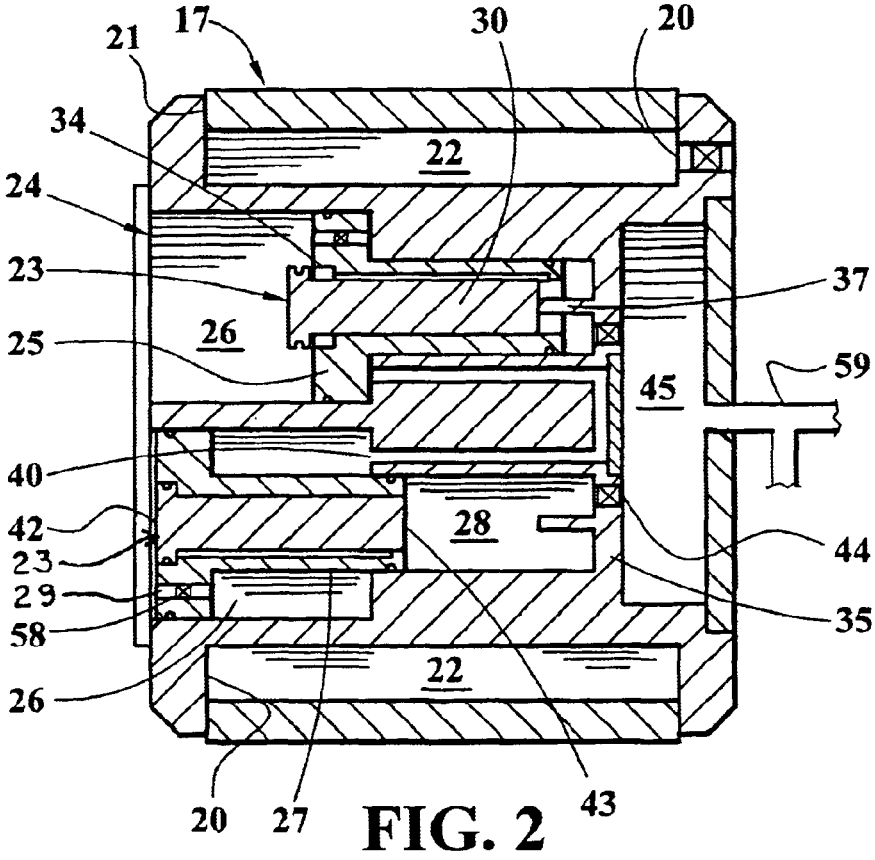
FIG. 2 is an enlarged view of the rear assembly component of the embodiment of FIG. 1.
Figure 3:
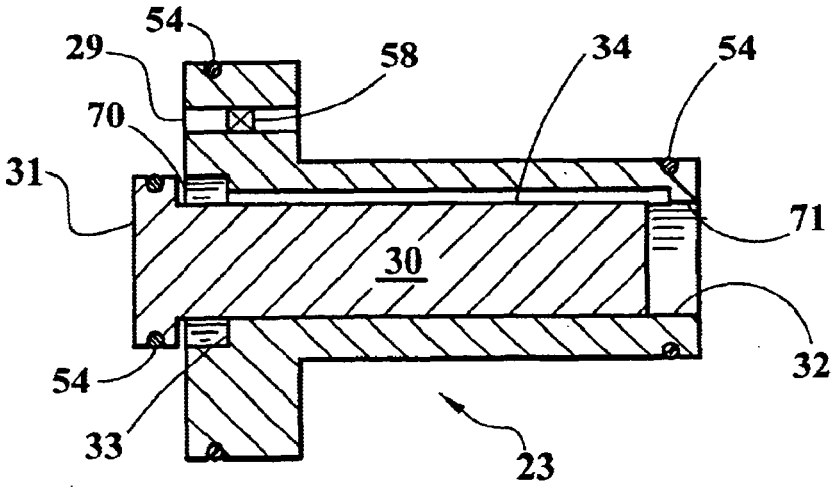
FIG. 3 is an enlarged view of the piston device component of the embodiment of FIG. 2.
Figure 4:
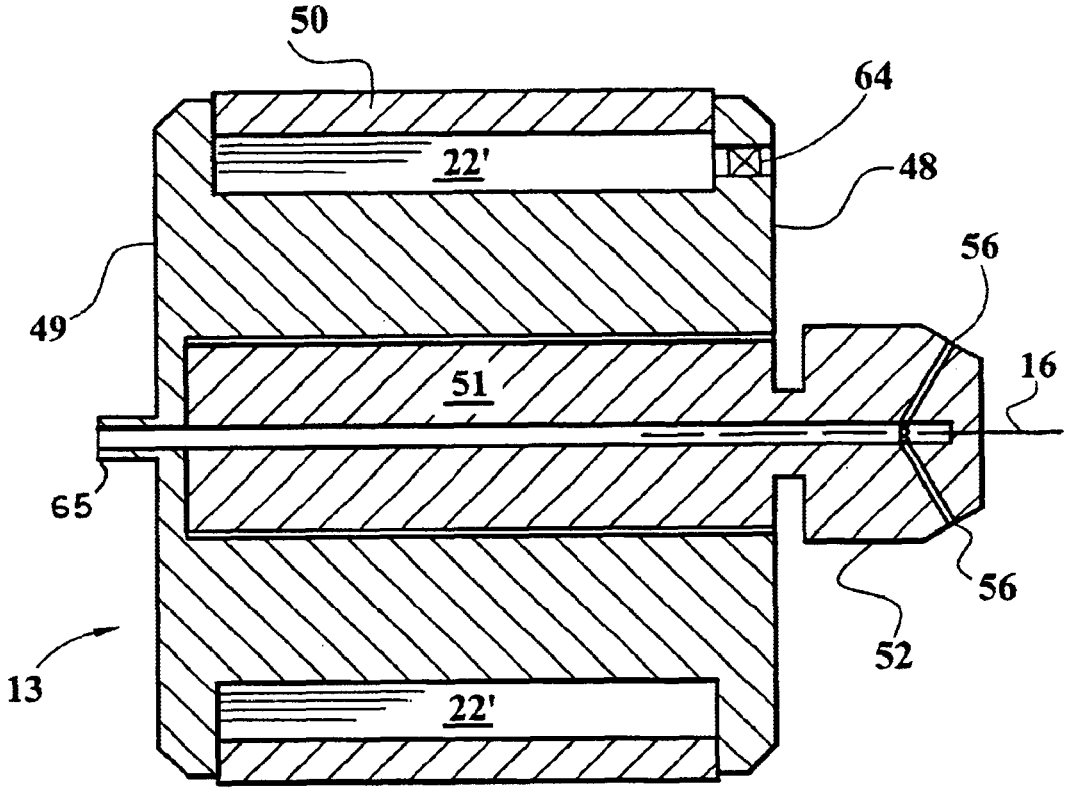
FIG. 4 is an enlarged view of the front assembly component of the embodiment of FIG. 1.
Figure 5:
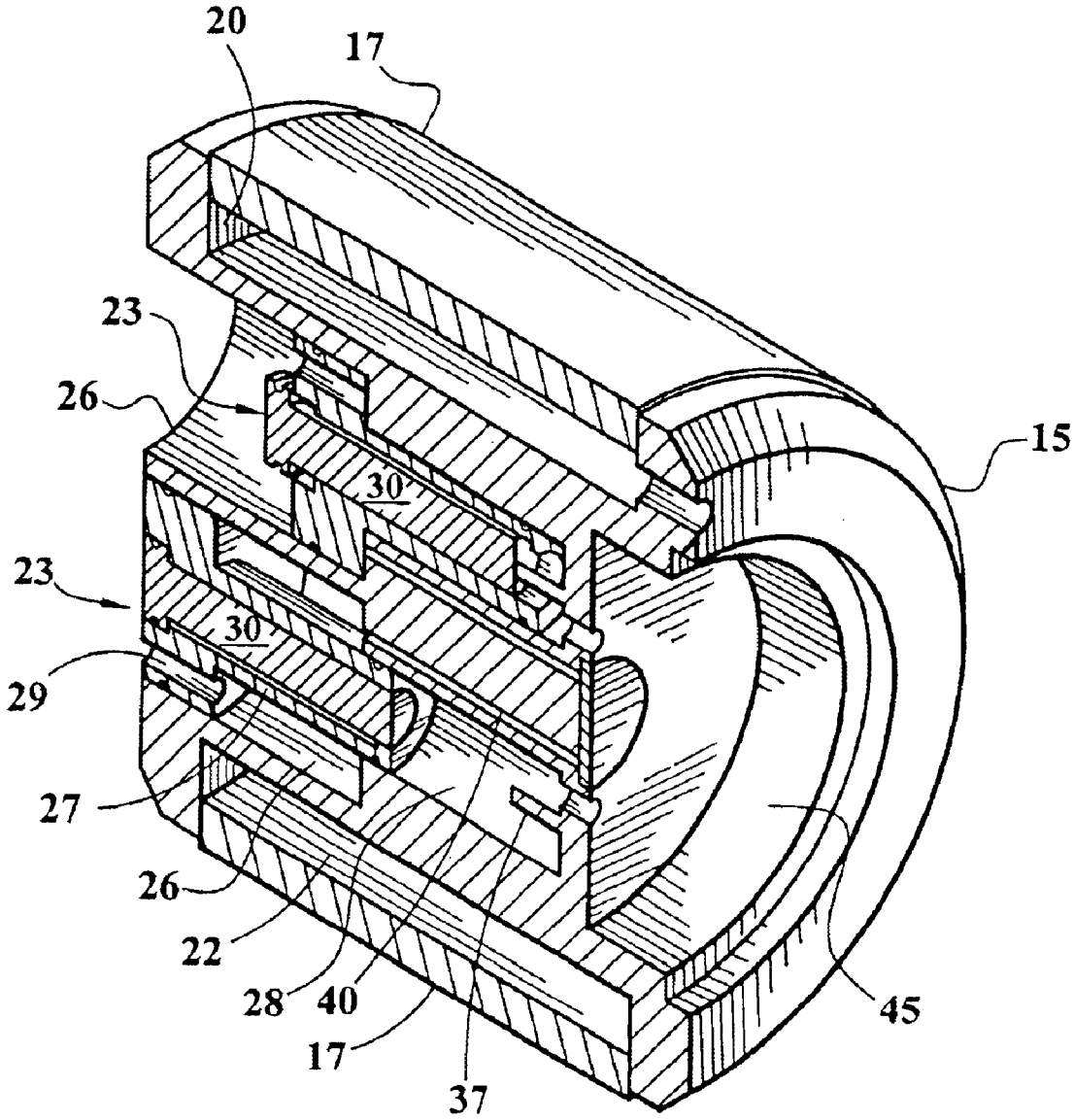
FIG. 5 is an enlarged view, in perspective format, of the sectional view of FIG. 2.
Figure 6:
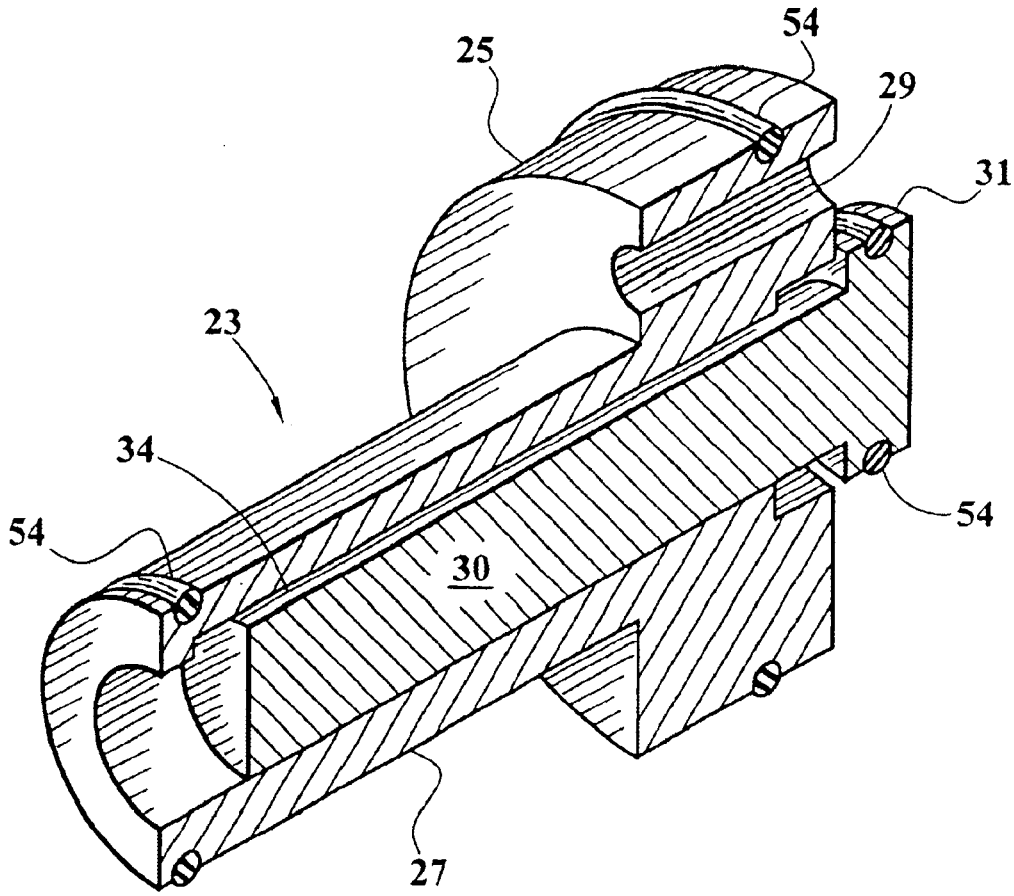
FIG. 6 is an enlarged view, in perspective format, of the sectional view of FIG. 3.
Figure 7:
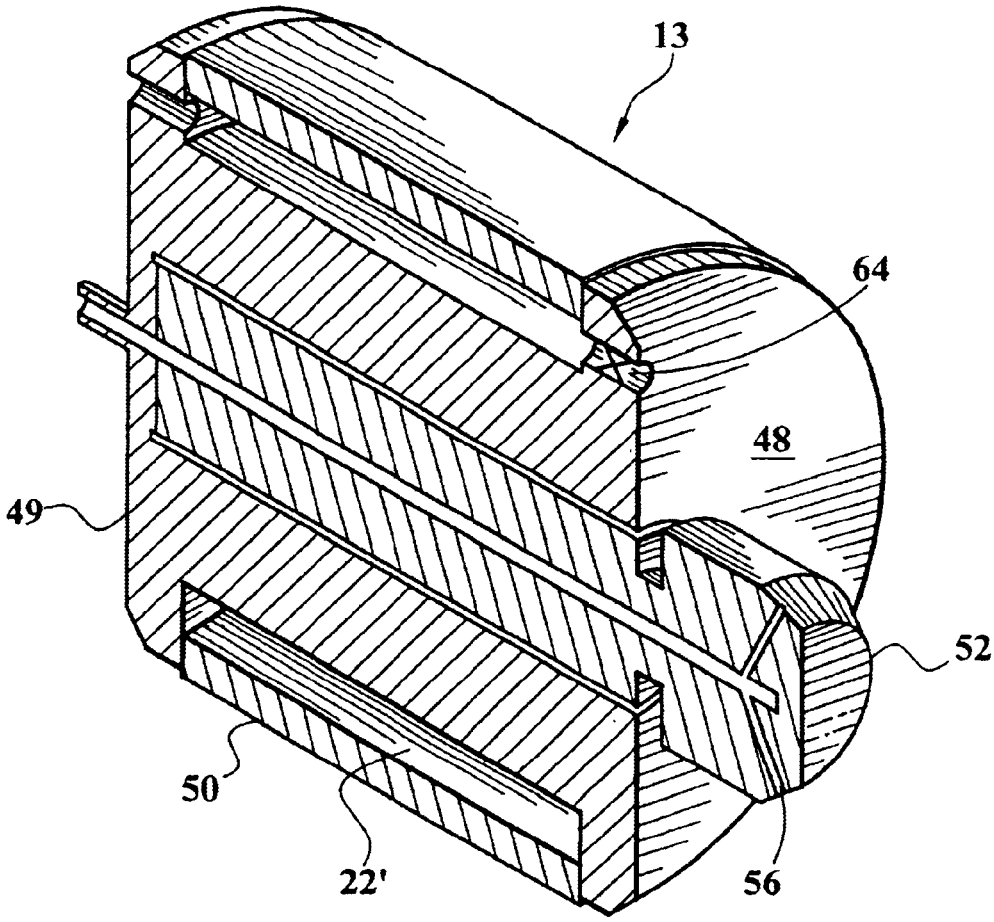
FIG. 7 is an enlarged view, in perspective format, of the sectional view of FIG. 4.
Figure 8:
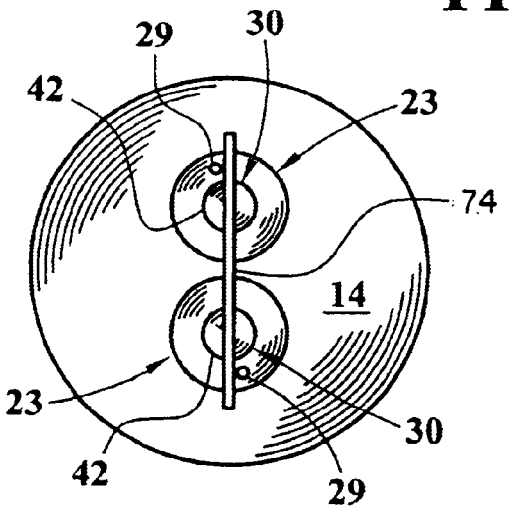
FIG. 8 is a rear view of the embodiment of FIG. 1.
Figure 9:
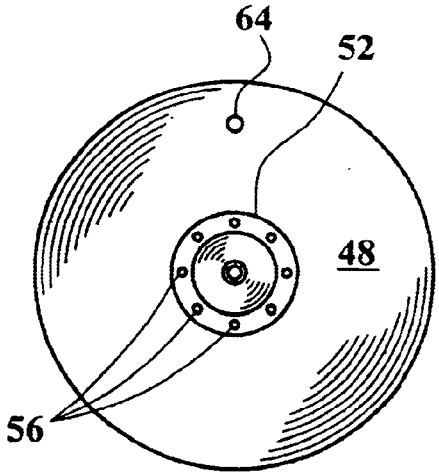
FIG. 9 is a front view of the embodiment of FIG. 1.

Referring now to FIGS. 1–9, an embodiment of the conduit cleaning pig apparatus 10 of the present invention is shown comprised of rear assembly 11, front assembly 13 and coupling means 12 interactively disposed between said rear and front assemblies, and positioning said assemblies upon a common center axis 16 coincident with the axis of conduit 18. An upstream supply of a fluid such as water at a primary pressure serves to advance the pig along the conduit.

Rear assembly 11 is bounded by upstream and downstream faces 14 and 15, respectively, and a pliable inflatable sidewall 17 of circular cylindrical configuration. Said sidewall is centered upon axis 16, and has an outside diameter which closely matches the diameter of the interior surface of said conduit.

Sidewall 17 is comprised of a circular band 18 fabricated of a resilient material whose outer surface 19 has good durability with respect to erosive wear and has a coefficient of friction with respect to said interior conduit surface of between 0.3 and 0.5. Said coefficient of friction between two surfaces is the ratio of the force required to move one over the other to the total force pressing the two together. If F is the force required to move one surface over another and W is the force pressing the surfaces together, the coefficient of friction U is expressed as U=F/W.

Band 18 is held within circumferential groove 20 in a manner providing tight sealing engagement with the edge extremities 21 of said band, thereby defining annular chamber 22. When said chamber is pressurized it causes radial expansion of band 18, forcing it into tight engagement with the interior surface of the conduit, thereby producing a braking effect with respect to movement of the pig within the conduit.

Two identical piston devices 23 are disposed in said rear assembly slideably retained by cylinders 24 in a manner permitting alternating reciprocal motion of the piston devices in directions coextensive with axis 16. Said piston devices and associated cylinders are of stepped configuration wherein a large diameter rear piston portion 25 and associated large cylinder portion 26 is contiguous with forwardly located narrow diameter piston portion 27 and interactive cylinder portion 28 having end closure panel 35. A passage 29 equipped with a check valve 58 extends through rear portion 25 of said piston to permit entrance of upstream pressurized water into associated large cylinder portion 26.

A poppet piston 30 having an outwardly extended head 31 is slideably positioned within a center bore 32 in each piston device, said bore having open upstream and downstream extremities, 70 and 71, respectively. An annular retaining shoulder 33 extends radially outwardly from bore 32 for the purpose of abutting with head 31 to limit forward sliding travel of said poppet piston. A low pressure water bypass channel 34 is axially recessed into each bore 32 and terminates just short of downstream extremity 71 in a manner such that, when said poppet piston is rearwardly displaced from bore 32, water can bypass said bore between said upstream and downstream extremities. An actuator post 37 is rearwardly directed from closure panel 35 of cylinder portion 28, and serves to push said poppet piston rearwardly to permit said bypass flow.

Such arrangement of piston devices represents an intensifier mechanism, and its operation involves two water circuits. A first circuit is essentially a closed loop circuit that operates at the primary pressure of the water being pumped into the pipeline upstream of the pig. Its purpose is to return the piston devices to a rearward starting position in an alternating pattern. Its flow is controlled through the use of one-way valves. One such valve, valve 58, associated with passage 29 permits initial input of water for charging the conduit. A communicating passageway 40 enables forward motion of one piston device to force water into the large cylinder portion 26 of the cylinder 24 of the other piston device, said large cylinder portion 26 functioning as a low pressure cylinder.

A second circuit is the high pressure intensifier circuit, and is explained as follows. As shown in FIG. 1, poppet bypass channel 34 of the lower piston device is open and first circuit feedback pressure from the upper piston device is forcing the lower piston device rearwardly to its starting position. As the lower piston device moves rearwardly, the upstream activating water that is being pumped into the conduit behind the device, having a primary pressure of about 500 psi, flows around the head of the poppet piston, down channel 34 and into the associated high pressure compression cylinder 28.

As the lower piston device reaches its maximum rear position, the head 31 of the poppet piston contacts retainer bar 74 bolted to upstream face 14, an action which pushes the poppet piston forwardly, thereby shutting off the flow of water through channel 34 into the high pressure cylinder. This effectively forms a water tight seal for the piston device.

In the exemplified embodiment, the surface area ratio between the head 42 of each piston device, when flush with rear face 14 of the rear assembly, and forward face 43 is 4 to 1. As the piston device is forced forwardly to the bottom of its stroke by activating water at 500 psi acting against head 42, the 4 to 1 ratio between the areas of the two faces 42 and 43 of the piston device results in water accumulating in cylinder 28 at a pressure of 2000 psi. As the water in cylinder 28 is being pressurized, it is released through a one-way check valve 44 into a high pressure holding chamber 45 known as an attenuator.

When the lower piston device reaches the bottom of its stroke, activator post 37 will contact poppet piston 30, pushing it rearwardly and thereby opening channel 34 to provide a flow path for low pressure activating water through the piston device. Passageway 40 communicates between the large diameter cylinder portions 26 of the two piston devices. This serves to provide reciprocating movement of the two piston devices because, as one piston device is moving forwardly it forces water through passageway 40 which, in turn, pushes the second piston device rearwardly. At start-up of the pig apparatus, one piston device is placed in its forwardmost position, and the other piston device is placed in its rearwardmost position. O-rings 54 assure watertight engagement of all moveable piston bodies with their interactive cylinder components.

The purpose of the attenuator is to act as a holding chamber for the second, high operating pressure water and to minimize any pressure variations caused by the alternating operation of the opposing piston devices. The attenuator has an output connector 59 for attaching a high pressure rated conduit line such as tube or hose 61 which communicates with front assembly 13.

Front assembly 13 is bounded by front and rear faces, 48 and 49, respectively, and sidewall 50 having the same construction and functionality as sidewall 17 of rear assembly 11 thereby defining a forward annular chamber 22'. Said chamber 22' is supplied with pressurized water from attenuator chamber 45 by way of line 62 which branches off line 61 and includes a flow limiter 63 and feed line 69 to chamber 22. Said flow limiter is set to be less than the flow capacity of a release valve 64 communicating with chamber 22' and positioned in the front face 48 of said front assembly 13. By virtue of such piping arrangement the pressure of water supplied to chambers 22 and 22' is controlled to a predetermined third operating pressure which is less than said second operating pressure but greater than the primary operating pressure.

A nozzle 51, having a supply stem 65, is rotatably centered upon axis 16 within said front assembly, and extends to a head 52 that protrudes forwardly of front face 48. Stem 65 is supplied with water from line 61 at said second operating pressure. A plurality of orifices 56 are located in head 52 in angled relationship to axis 16 and directed toward conduit 18. The angled relationship of the orifices causes the reaction effect of emergent high velocity water jets to propel the nozzle about its axis of rotation.

Coupling means 12 has a yoke assembly 53 and accommodates the aforesaid lines that convey pressurized water to chambers 22 and 22' and nozzle 51. The coupling means also provides a limited amount of bending movement of the front and rear assemblies relative to axis 16, thereby imparting sufficient flexibility to the pig apparatus to enable it to travel through sharp bends in to the conduit pipeline.

The pliable sidewalls of both front and rear assemblies operate at pressures greater than the primary pressurized water located in the serviced pipeline behind the rear assembly, thereby providing a water tight seal between the pipeline portion located behind the pig apparatus of this invention and the downstream pipeline portion located in front of the apparatus. As pressure builds in chambers 22 and 22' to the predetermined third operating pressure, the resulting force applied by the sidewalls against the interior surface of the pipeline quickly exceeds the thrusting force being applied by the primary pressure of the water behind the rear assembly, resulting in the device becoming a water tight plug. However, when the primary pressure is increased sufficiently, the force exerted upon the rear assembly will exceed the force exerted by the pliable sidewalls upon the interior surface of the conduit. When this happens, the apparatus will start to move through the pipeline at a speed determined by the volume of water being introduced into the pipeline. If the primary pressure in the pipeline behind the pig is allowed to drop below the force threshold required to overcome the force being applied by the sidewalls against the pipeline wall, then forward motion will cease and the device will once again become a water tight plug. The flow of intensified water through the apparatus may be less than 5 gallons per minute. Any excess water generated by the intensifier is directed through nozzle 51. As water is virtually non-compressible, progress of the device may be precisely controlled over distances of several miles by varying the primary pressure and flow rate of the upstream activating water. The motion of the device may be reversed by removing water pressure from the rear of the device while applying water pressure to the front of the device.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described our invention, what is claimed is:

1. A pig apparatus for removing deposits from the interior surface of a conduit while being advanced through said conduit by impetus provided by an upstream activating liquid of adjustable pressure and flow exerting a primary operating pressure upon said apparatus, said apparatus comprising:

a) a rear assembly bounded by upstream and downstream faces and a circular cylindrical sidewall, thereby defining an interior region, and intensifier means located in said interior region for increasing said primary operating pressure to a second operating pressure, b) a front assembly bounded by front and rear faces in spaced apart parallel relationship on a centered axis and a pliable circular cylindrical sidewall having an outside diameter that closely matches the diameter of the interior surface of said conduit and is outwardly expandable by pressure applied from within said front assembly, said front face having nozzle means adapted to rotate upon said axis under the impetus of said second operating pressure liquid, said nozzle means having a forward extremity equipped with a plurality of orifices which produce high velocity jets of liquid directed toward said interior surface, c) valved flow control means which divert a portion of the liquid at said second operating pressure, causing said diverted liquid to have a third operating pressure which is less than said second operating pressure but higher than said primary pressure, and causing said third operating pressure liquid to activate said pliable sidewall, and d) coupling means interactive between the downstream face of said rear assembly and the rear face of said front assembly for facilitating transfer of liquid at said second and third operating pressure and permitting limited movement between said front and rear assemblies.

2. The apparatus of claim 1 wherein said intensifier means comprises at least one piston device and cylinder assembly.

3. The apparatus of claim 2 having two piston device, and cylinder assemblies, said assemblies being interactive in a reciprocating manner.

4. The apparatus of claim 3 wherein said piston devices and associated cylinders are of stepped configuration wherein a large diameter rear piston portion and associated large cylinder portion is contiguous with a forwardly located narrow diameter piston portion and associated narrow diameter cylinder portion.

5. The apparatus of claim 4 wherein a passage equipped with a check valve extends through the rear portion of said piston devices to allow upstream activating liquid at said primary operating pressure to enter the associated large cylinder portion.

6. The apparatus of claim 3 wherein a poppet piston is slideably positioned within each piston device and adapted to permit controlled bypass of liquid between the rear and forwardly located extremities of the piston device.

7. The apparatus of claim 1 wherein said second operating pressure is between 3 and 5 times greater than said primary operating pressure.

8. The apparatus of claim 1 wherein the orifices of said nozzle means are disposed in angular relationship to said axis, whereby the emergent high velocity jets cause rotation of said nozzle means.

9. The apparatus of claim 1 further comprising a pliable circular cylindrical sidewall in said rear assembly outwardly expandable by liquid at said third operating pressure.

10. The apparatus of claim 1 further comprising a holding chamber for liquid at said second operating pressure.

11. The apparatus of claim 10 wherein said holding chamber is located within said rear assembly.

12. The apparatus of claim 1 wherein said pliable sidewall is fabricated of a resilient material having a coefficient of friction with respect to the interior surface of said conduit of between 0.3 and 0.5.

13. The apparatus of claim 1 wherein said pliable sidewall, when outwardly expanded by said third operating pressure, exerts a breaking force upon the interior surface of said conduit which is sufficient to prevent forward motion of the apparatus along the conduit at a chosen primary operating pressure.

14. The apparatus of claim 13 wherein forward motion of said apparatus may be achieved by an increase in said primary operating pressure.

* * * * *